US007045261B2

(12) United States Patent
Tanaka et al.

(10) Patent No.: US 7,045,261 B2
(45) Date of Patent: May 16, 2006

(54) ELECTROPHOTOGRAPHIC PHOTOSENSITIVE MEMBER, PROCESS CARTRIDGE AND ELECTROPHOTOGRAPHIC APPARATUS

(75) Inventors: Takakazu Tanaka, Shizuoka (JP); Itaru Takaya, Kanagawa (JP); Harunobu Ogaki, Shizuoka (JP); Kenichi Kaku, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 10/647,274

(22) Filed: Aug. 26, 2003

(65) Prior Publication Data

US 2004/0048179 A1 Mar. 11, 2004

(30) Foreign Application Priority Data

Aug. 30, 2002 (JP) ..... 2002-253630

(51) Int. Cl.
*G03G 5/05* (2006.01)

(52) U.S. Cl. ..... 430/58.05; 430/58.15; 430/58.35; 430/58.5; 430/58.6; 430/58.7; 399/159

(58) Field of Classification Search ..... 430/58.05, 430/58.15, 58.35, 58.5, 58.6, 58.7; 399/159
See application file for complete search history.

(56) References Cited

U.S. PATENT DOCUMENTS

| | | | | |
|---|---|---|---|---|
| 4,806,443 | A | 2/1989 | Yanus et al. | 430/56 |
| 5,116,708 | A | 5/1992 | Shikatani et al. | 430/59 |
| 5,654,119 | A | 8/1997 | Ishii et al. | 430/59 |
| 5,733,697 | A | 3/1998 | Endoh et al. | 430/59 |
| 6,258,499 | B1 | 7/2001 | Itami | 430/66 |

FOREIGN PATENT DOCUMENTS

| | | |
|---|---|---|
| JP | 64-9964 | 1/1989 |
| JP | 2-282263 | 11/1990 |
| JP | 3-221522 | 9/1991 |
| JP | 8-208820 | 8/1996 |

*Primary Examiner*—Mark A. Chapman
(74) *Attorney, Agent, or Firm*—Fitzpatrick, Cella, Harper & Scinto

(57) ABSTRACT

In an electrophotographic photosensitive member having a support, and provided thereon a photosensitive layer, a surface layer of the electrophotographic photosensitive member contains a high-molecular-weight charge-transporting material having a weight-average molecular weight Mw of from 1,000 or more to 9,000 or less, and the ratio of the weight-average molecular weight Mw of the high-molecular-weight charge-transporting material to a number-average molecular weight Mn of the high-molecular-weight charge-transporting material, Mw/Mn, is from more than 1.00 to 1.10 or less. Also disclosed are a process cartridge and an electrophotographic apparatus which have such an electrophotographic photosensitive member.

11 Claims, 1 Drawing Sheet

FIGURE
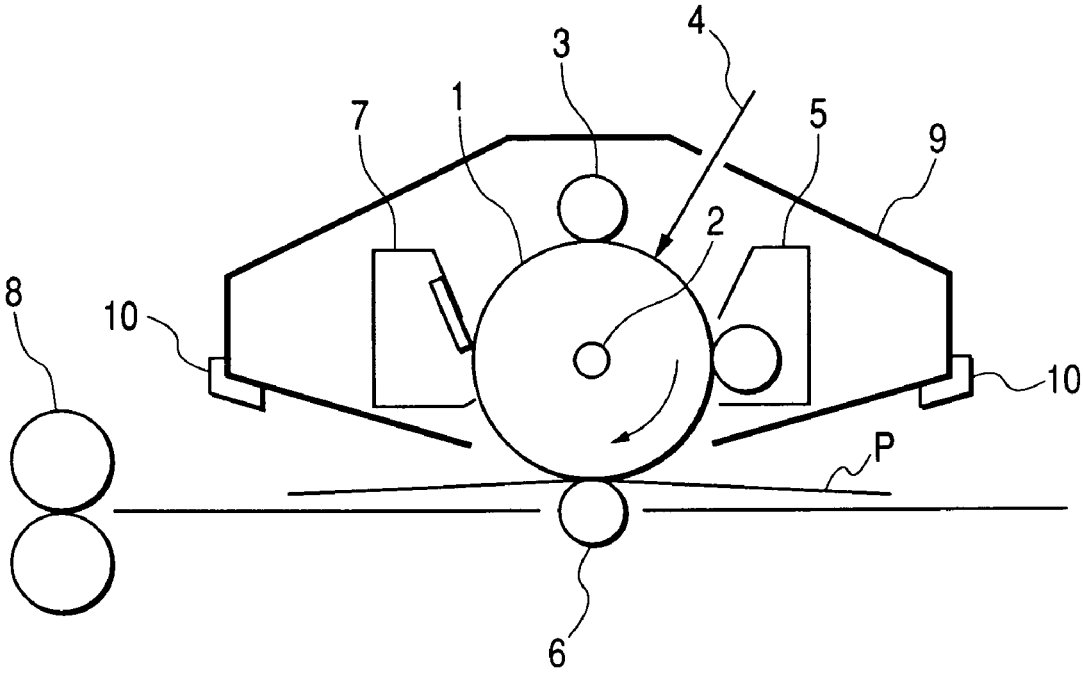

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

In recent years, for the purpose of overcoming disadvantages of inorganic electrophotographic photosensitive members making use of inorganic photoconductive materials, organic electrophotographic photosensitive members making use of organic photoconductive materials are energetically put forward. In order to satisfy both electrical properties and mechanical properties, organic electrophotographic photosensitive members are often provided with a photosensitive layer which is a multi-layer type (function-separated type) photosensitive layer in which a charge generation layer containing a charge-generating material and a charge transport layer containing a charge-transporting material are superposingly formed.

Electrophotographic photosensitive members are required to have a stated sensitivity, electrical properties and optical properties which have been adapted to electrophotographic processes applied. Electrophotographic photosensitive members are also required to have durability to electrical and mechanical external forces because such forces are directly applied to their surfaces through corona charging or contact charging, imagewise exposure, development by toner, image transfer, surface cleaning and so forth.

As methods for improving wear resistance of the surfaces of organic electrophotographic photosensitive members, known in the art are a method in which the binder resin of a surface layer is made to have a high molecular weight, a method in which a filler is added to the binder resin of a surface layer, a method in which the structure of a binder resin is incorporated with a siloxane structure or a structure for imparting lubricity (slipperiness) such as a fluorine-containing substituent or a solid lubricant such as polytetrafluoroethylene (PTFE) is added so as to reduce the coefficient of friction with cleaning means such as a cleaning blade.

As another method for improving wear resistance of the surfaces of organic electrophotographic photosensitive members, it is proposed to use a binder resin having good mechanical strength.

However, even if the binder resin itself has good mechanical strength, its use in mixture with a low-molecular-weight charge-transporting material can not sufficiently make the most of the mechanical strength the binder resin has originally, and such a binder resin has not necessarily achieved satisfactory durability (wear resistance or scratch resistance). On the other hand, if the charge-transporting material is added in a smaller quantity in an attempt to make the most of the mechanical strength the binder resin has originally, a problem may arise such that it causes a lowering of electrophotographic sensitivity or a rise of residual potential. That is, this proposal has not achieved both the surface mechanical strength and the electrophotographic performance.

The method in which lubricity is imparted to the surfaces of electrophotographic photosensitive members to reduce the coefficient of friction with cleaning means such as a cleaning blade may also cause a lowering of the surface mechanical strength, and has not succeeded in achievement of sufficient durability.

The use of a high-molecular weight charge-transporting material for the purpose of better preventing the electrophotographic photosensitive member surface from having a low mechanical strength because of the addition of a low-molecular-weight charge-transporting material is disclosed in Japanese Patent Applications Laid-open No. H64-9964, No. H02-282263, No. H03-221522, No. H08-208820 and so forth. In many of these, however, it is not necessarily the case that the surfaces have sufficient wear resistance. Even in those having a mechanical strength to a certain extent as well, there has been a disadvantage that the manufacturing cost is too high to be suited for practical use.

SUMMARY OF THE INVENTION

An object of the present invention is to solve the above problems to provide an electrophotographic photosensitive member having high surface mechanical strength, having superior durability (wear resistance or scratch resistance) and also having stability in repeated use, and a process cartridge and an electrophotographic apparatus which have such electrophotographic photosensitive member.

That is, the present invention is an electrophotographic photosensitive member comprising a support, and provided thereon a photosensitive layer, wherein;

a surface layer of the electrophotographic photosensitive member contains a high-molecular-weight charge-transporting material having a weight-average molecular weight Mw of from 1,000 or more to 9,000 or less; and the ratio of the weight-average molecular weight Mw of the high-molecular-weight charge-transporting material to a number-average molecular weight Mn of the high-molecular-weight charge-transporting material, Mw/Mn, is from more than 1.00 to 1.10 or less.

The present invention is also a process cartridge and an electrophotographic apparatus which have the above electrophotographic photosensitive member.

BRIEF DESCRIPTION OF THE DRAWING

The single FIGURE is a schematic view showing an example of the construction of an electrophotographic apparatus provided with a process cartridge having the electrophotographic photosensitive member of the present invention.

DESCRIPTION OF PREFERRED EMBODIMENTS

The present invention is described below in detail.

The electrophotographic photosensitive member of the present invention has a support and a photosensitive layer provided on the support, and has a surface layer containing a high-molecular-weight charge-transporting material. The high-molecular-weight charge-transporting material used in the surface layer of the electrophotographic photosensitive member of the present invention (hereinafter "high-molecular-weight charge-transporting material of the present invention") has a specific molecular weight distribution as mentioned above. In the present invention, the molecular weight distribution is meant to be the ratio of weight-average molecular weight Mw to number-average molecular weight Mn, Mw/Mn.

As mentioned above, the ratio of the weight-average molecular weight Mw of the high-molecular-weight charge-transporting material of the present invention to the number-average molecular weight Mn of the high-molecular-weight charge-transporting material, Mw/Mn, is from more than 1.00 to 1.10 or less. From the viewpoint of productivity, it may preferably be from 1.01 or more to 1.10 or less.

The high-molecular-weight charge-transporting material of the present invention is a material having a weight-average molecular weight Mw of from 1,000 or more to 9,000 or less, and has poor film-forming properties. Hence, in the surface layer of the electrophotographic photosensitive member of the present invention, the high-molecular-weight charge-transporting material of the present invention and an electrically insulating binder resin may preferably be used in combination. The use of an electrically insulating binder resin in combination can broaden the range of selection in respect of the mechanical strength of the electrophotographic photosensitive member surface and the productivity and cost of the electrophotographic photosensitive member. In this regard, the present invention differs from an example in which a binder resin is endowed with the function of charge transport or an example in which a charge-transporting material is endowed with the function of a binder.

As stated above, the high-molecular-weight charge-transporting material of the present invention has a weight-average molecular weight Mw of from 1,000 or more to 9,000 or less, in particular, preferably from 1,500 or more to 9,000 or less, and more preferably from 1,500 or more to 4,000 or less. If the charge-transporting material has too large weight-average molecular weight Mw, it may have a low compatibility with the binder resin to make the surface layer of the electrophotographic photosensitive member have a low mechanical strength, or portions having charge transport function may localize in the layer to cause a lowering of electrophotographic performance (e.g., the trapping of electric charges). If on the other hand the charge-transporting material has too small weight-average molecular weight Mw, an insufficient improvement in charge transport performance may result.

The high-molecular-weight charge-transporting material of the present invention may preferably be a homopolymer having a repeating structural unit represented by the following Formula (1).

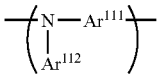

(1)

In Formula (1), $Ar^{111}$ represents a substituted or unsubstituted divalent aromatic hydrocarbon ring group other than a phenylene group, or a substituted or unsubstituted divalent aromatic heterocyclic ring group. $Ar^{112}$ represents a substituted or unsubstituted monovalent aromatic hydrocarbon ring group or a substituted or unsubstituted monovalent aromatic heterocyclic ring group.

The high-molecular-weight charge-transporting material of the present invention may also preferably be a random copolymer having a repeating structural unit represented by the following Formula (21) and a repeating structural unit represented by the following Formula (22).

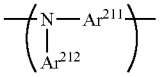

(21)

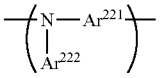

(22)

In Formulas (21) and (22), $Ar^{211}$ and $Ar^{221}$ each independently represent a substituted or unsubstituted divalent aromatic hydrocarbon ring group other than a phenylene group, or a substituted or unsubstituted divalent aromatic heterocyclic ring group, and $Ar^{212}$ and $Ar^{222}$ each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (21) and the repeating structural unit represented by Formula (22) are identical in structure.

The high-molecular-weight charge-transporting material of the present invention may still also preferably be an alternating copolymer alternately having a repeating structural unit represented by the following formula (31) and a repeating structural unit represented by the following Formula (32).

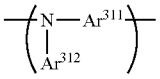

(31)

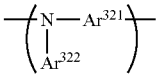

(32)

In Formula (31) and (32), $Ar^{311}$ and $Ar^{321}$ each independently represent a divalent group having a structure represented by the following Formula (41) or the following Formula (42), provided that $Ar^{311}$ and $Ar^{323}$ differ from each other in structure.

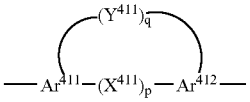

(41)

In Formula (41), $Ar^{411}$ and $Ar^{421}$ each independently represent a substituted or unsubstituted trivalent aromatic hydrocarbon ring group or a substituted or unsubstituted trivalent aromatic heterocyclic ring group. $X^{411}$ represents a substituted or unsubstituted alkylene group, a substituted or unsubstituted siloxane group, a substituted or unsubstituted silylene group, a carbonyl group, a sulfonyl group, an oxygen atom or a sulfur atom. $Y^{411}$ represents a substituted or unsubstituted alkylene group, a substituted or unsubstituted amino group, an azo group, a sulfonyl group, an oxygen atom or a sulfur atom. Letter symbols p and q each independently represent 0 or 1.

$$—Ar^{421}—(X^{421})_r—Ar^{422}— \quad (42)$$

In Formula (42), $Ar^{421}$ and $Ar^{422}$ each independently represent a substituted or unsubstituted divalent aromatic hydrocarbon ring group or a substituted or unsubstituted divalent aromatic heterocyclic ring group. $X^{421}$ represents a substituted or unsubstituted alkylene group, a substituted or unsubstituted siloxane group, a substituted or unsubstituted silylene group, a carbonyl group, a sulfonyl group, an oxygen atom or a sulfur atom. Letter symbol r represents 0 or 1.

$Ar^{312}$ and $Ar^{322}$ each independently represent a substituted or unsubstituted monovalent aromatic hydrocarbon ring group or a substituted or unsubstituted monovalent aromatic heterocyclic ring group.

The above monovalent aromatic hydrocarbon ring group may include phenyl, naphthyl, anthryl, pyrenyl, fluorenyl and phenanthryl. The above monovalent aromatic heterocyclic ring group may include quinolyl, dibenzothienyl, dibenzofuryl, n-methylcarbazole, n-ethylcarbazole and n-tolylcarbazole.

The above divalent aromatic hydrocarbon ring group may include divalent groups such as benzene, naphthalene, anthracene, perylene, fluorene, biphenyl and terphenyl from which two hydrogen atoms have been removed. The above divalent aromatic heterocyclic ring group may include divalent groups such as carbazole, furan, benzofuran, thiophene, benzothiophene, quinoline and phenazine from which two hydrogen atoms have been removed.

The above trivalent aromatic hydrocarbon ring group may include trivalent groups such as benzene, naphthalene, anthracene, perylene, fluorene, biphenyl and terphenyl from which three hydrogen atoms have been removed. The above trivalent aromatic heterocyclic ring group may include trivalent groups such as carbazole, furan, benzofuran, thiophene, benzothiophene, quinoline and phenazine from which three hydrogen atoms have been removed.

The above alkylene group may include a methylene group, an ethylene group and a propylene group.

The substituent each of the above groups may have may include alkyl groups such as a methyl group, an ethyl group, a propyl group and a butyl group; alkoxyl groups such as a methoxyl group, an ethoxyl group and a propoxyl group; aryloxy groups such as a phenoxyl group and a naphthoxyl group; halogen atoms such as a fluorine atom, a chlorine atom and a bromine atom; and di-substituted amino groups such as a dimethylamino group, a diethylamino group and a diphenylamino group.

Examples of the repeating structural units constituting the high-molecular-weight charge-transporting materials of the present invention are shown below. The present invention is by no means limited to these.

(CT-1)

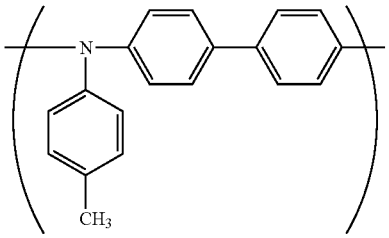

-continued (CT-2)

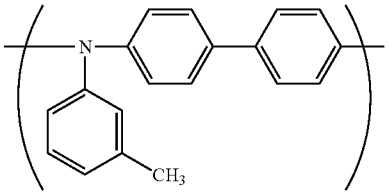

(CT-3)

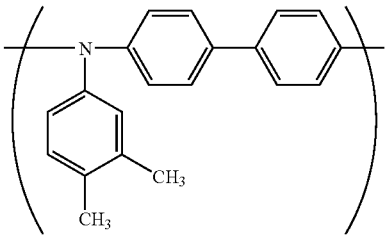

(CT-4)

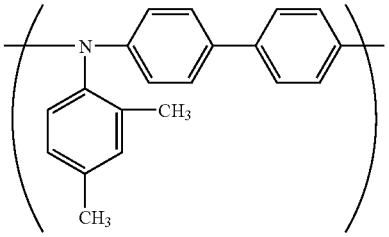

(CT-5)

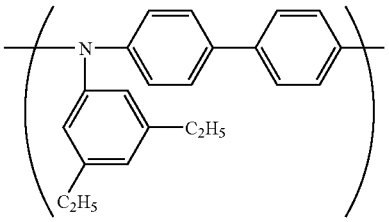

(CT-6)

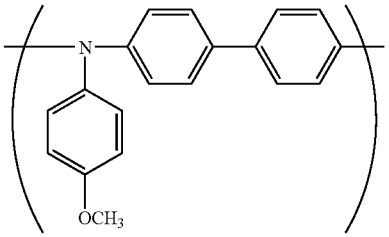

(CT-7)

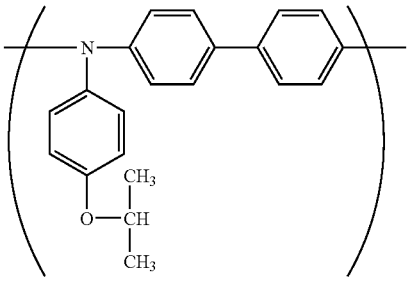

-continued
(CT-8)
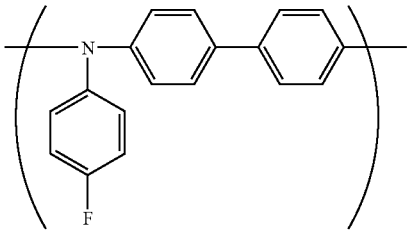
(CT-9)
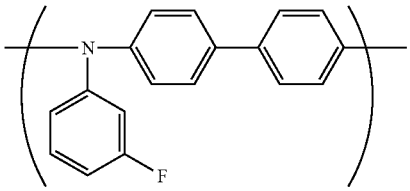
(CT-10)
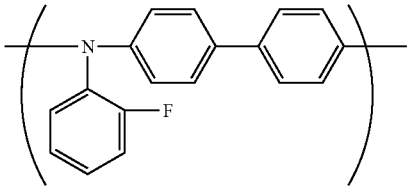
(CT-11)
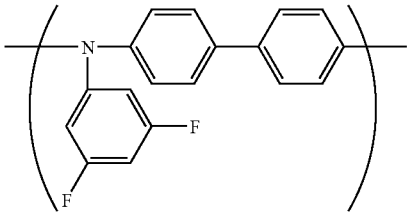
(CT-12)
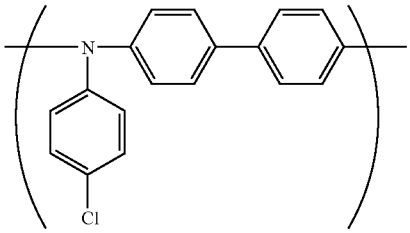
(CT-13)
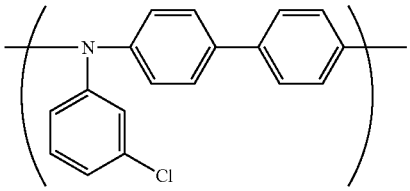
(CT-14)
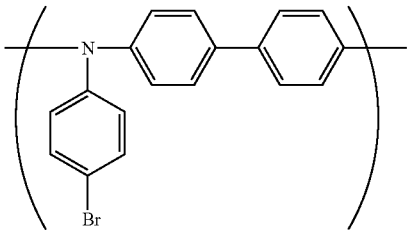
-continued
(CT-15)
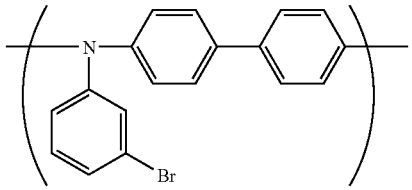
(CT-16)
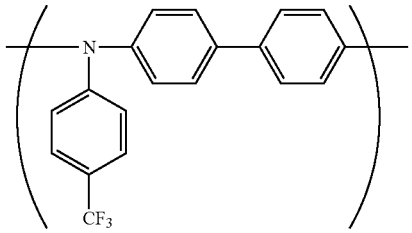
(CT-17)
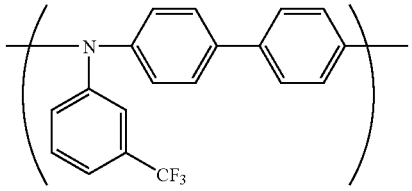
(CT-18)
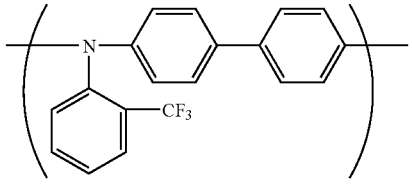
(CT-19)
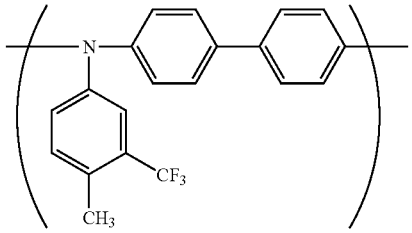
(CT-20)
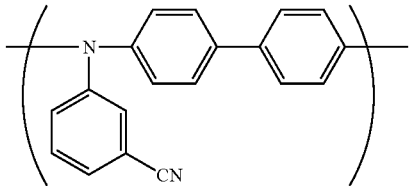
(CT-21)
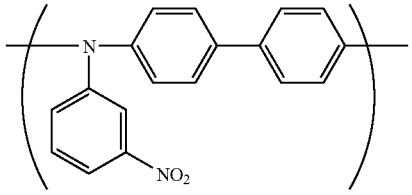

-continued
(CT-22)
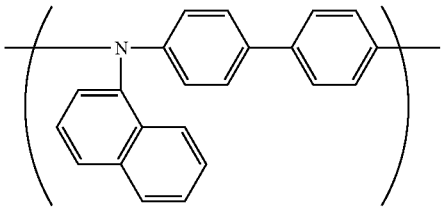
(CT-23)
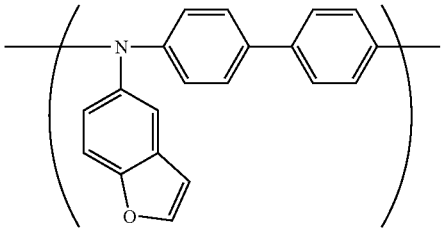
(CT-24)
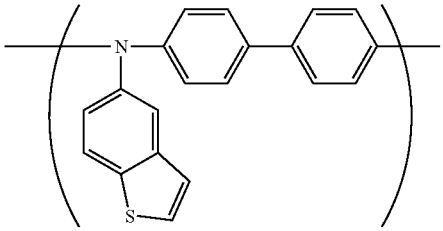
(CT-25)
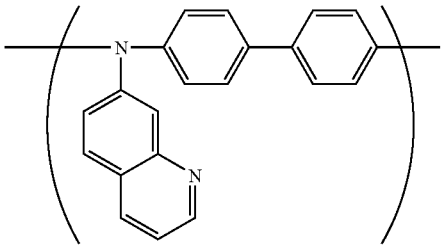
(CT-26)
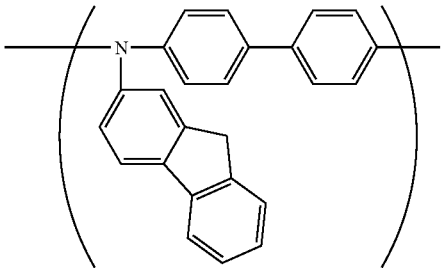
(CT-27)
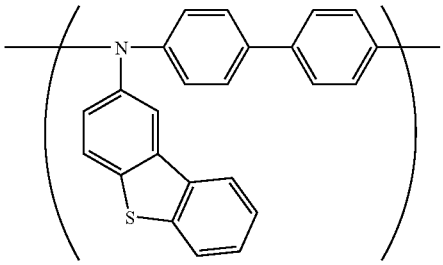
-continued
(CT-28)
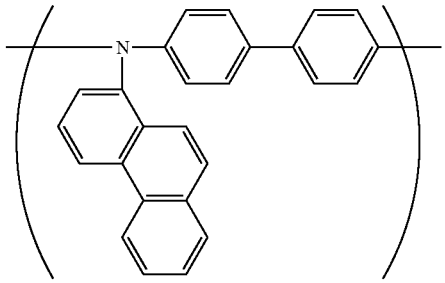
(CT-29)
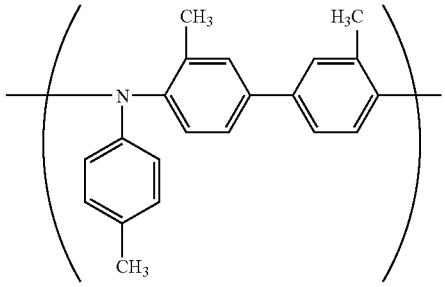
(CT-30)
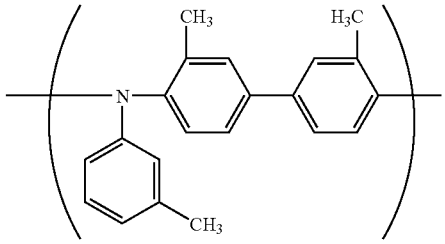
(CT-31)
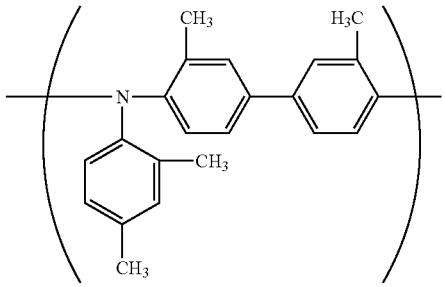
(CT-32)
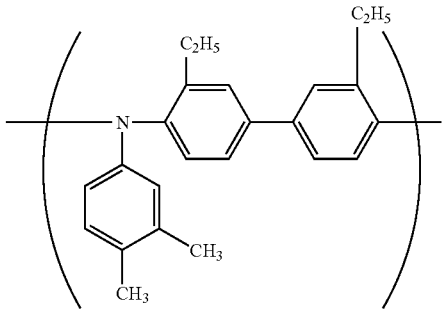

-continued
(CT-33)
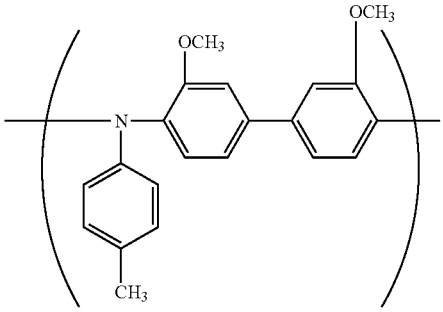
(CT-34)
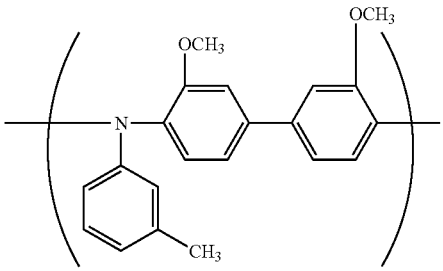
(CT-35)
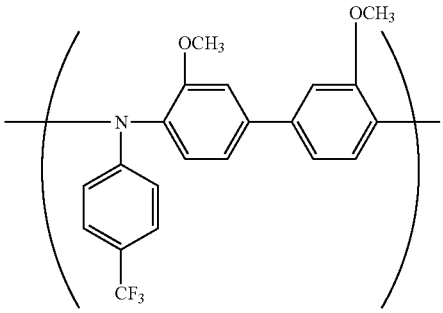
(CT-36)
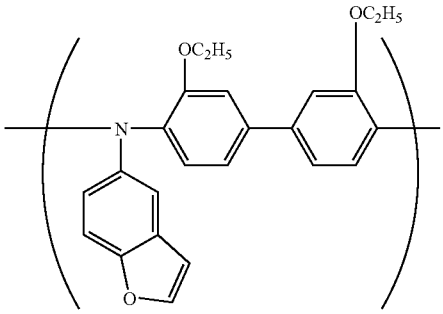
(CT-37)
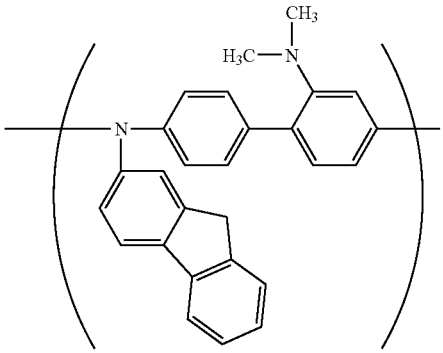
-continued
(CT-38)
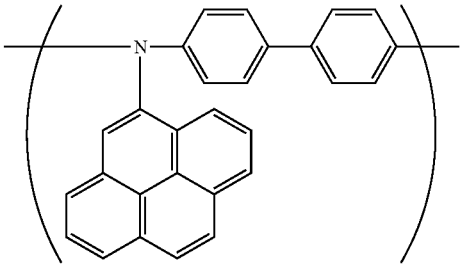
(CT-39)
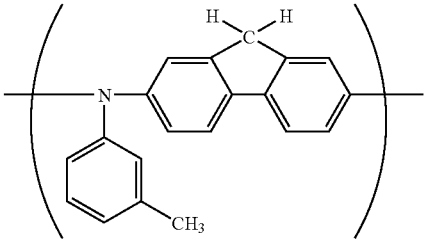
(CT-40)
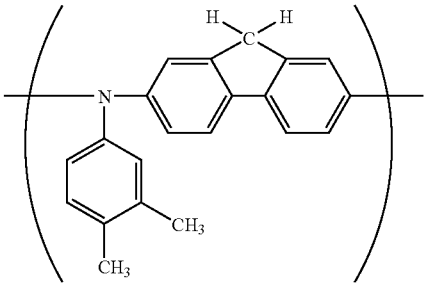
(CT-41)
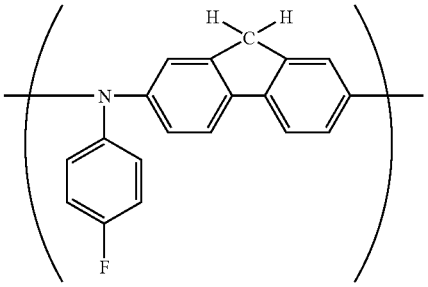
(CT-42)
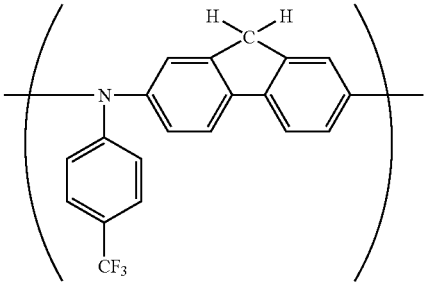

-continued
(CT-43)
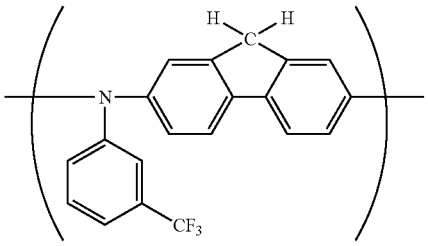
(CT-44)
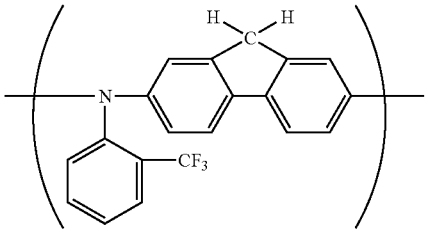
(CT-45)
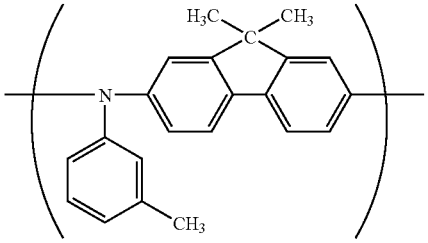
(CT-46)
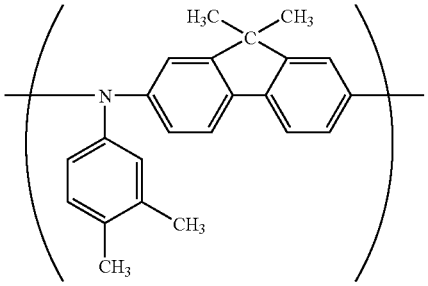
(CT-47)
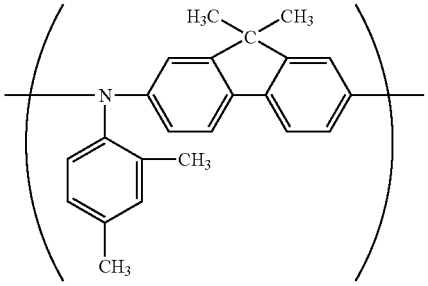
(CT-48)
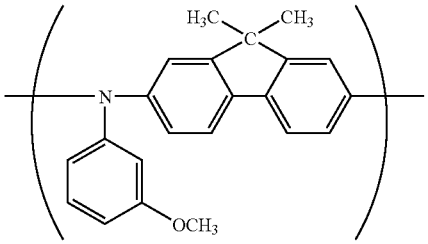
-continued
(CT-49)
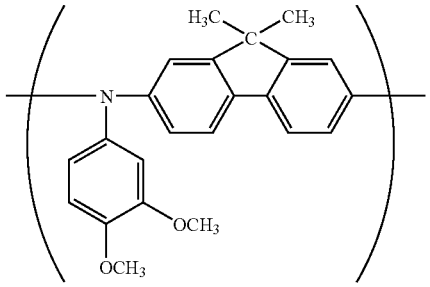
(CT-50)
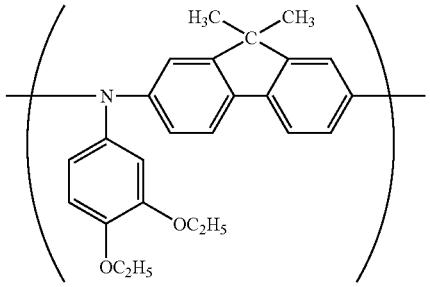
(CT-51)
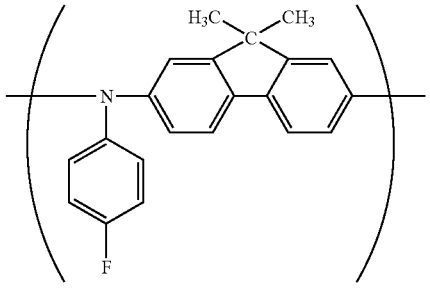
(CT-52)
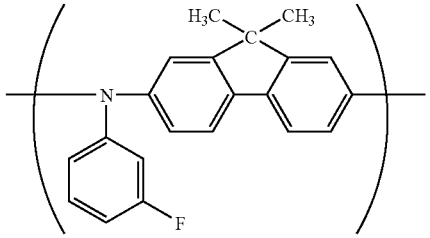
(CT-53)
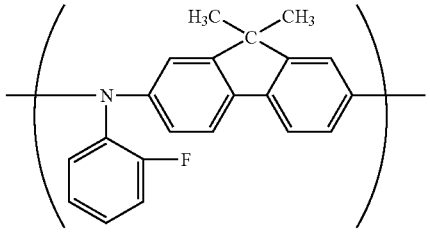
(CT-54)
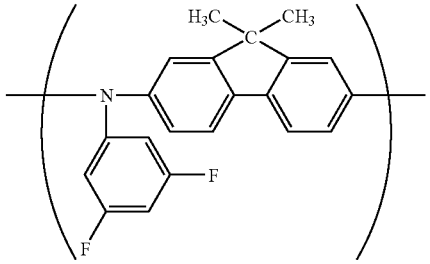

-continued
(CT-55)
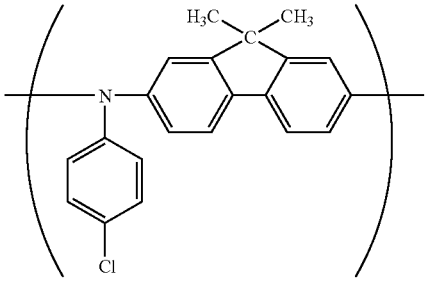
(CT-56)
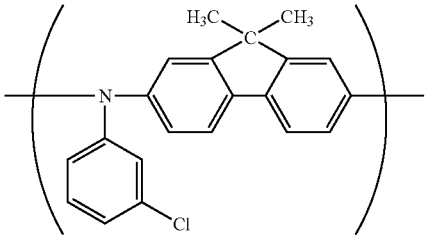
(CT-57)
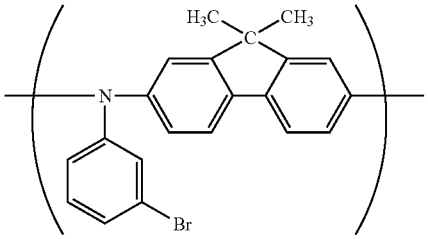
(CT-58)
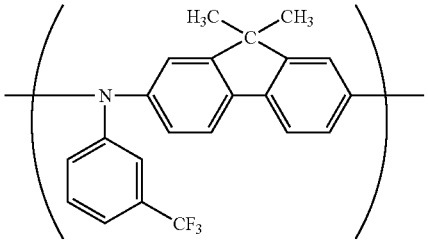
(CT-59)
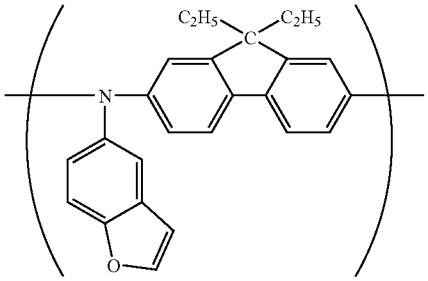
(CT-60)
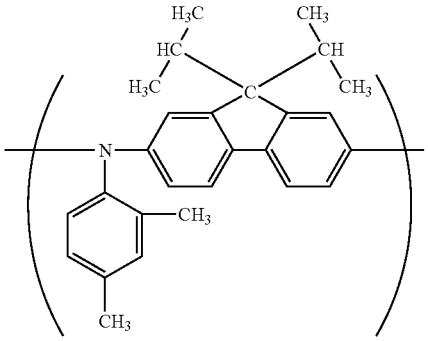
-continued
(CT-61)
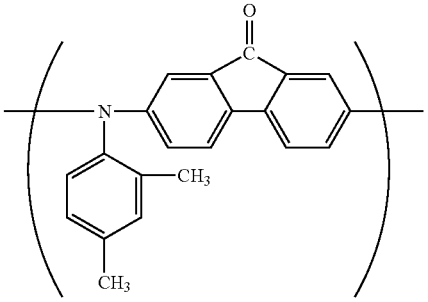
(CT-62)
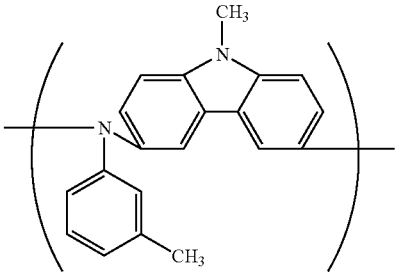
(CT-63)
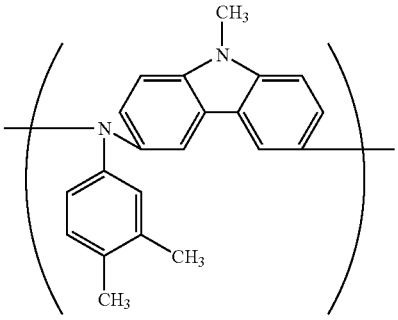
(CT-64)
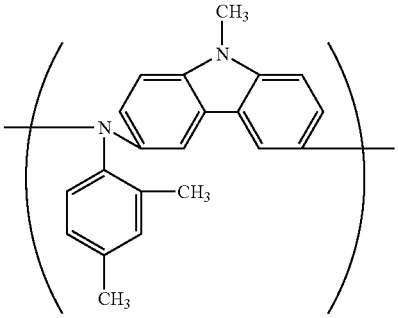
(CT-65)
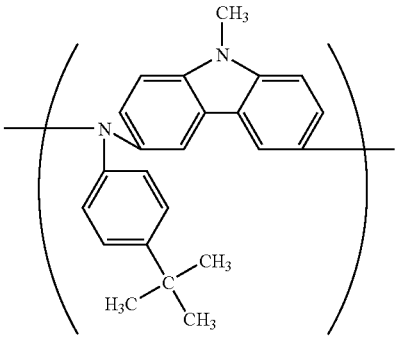

-continued
(CT-66)
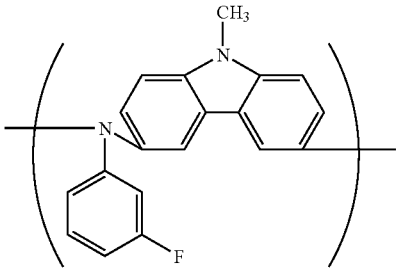
(CT-67)
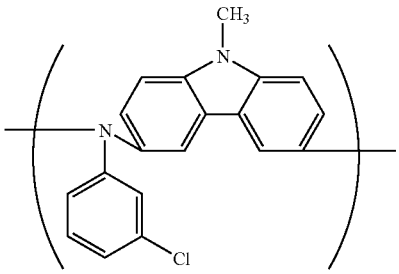
(CT-68)
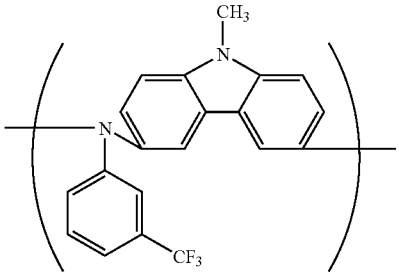
(CT-69)
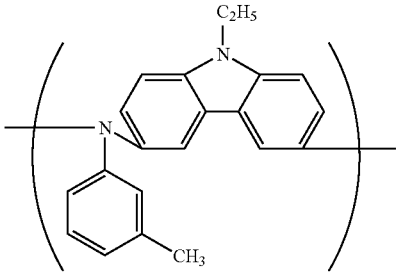
(CT-70)
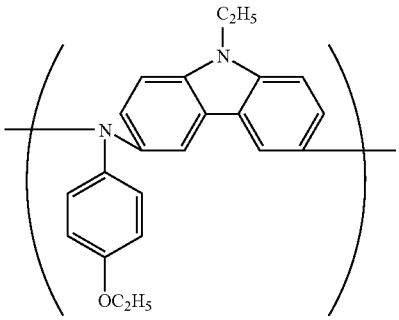
-continued
(CT-71)
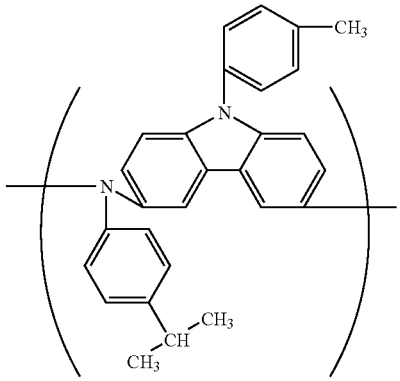
(CT-72)
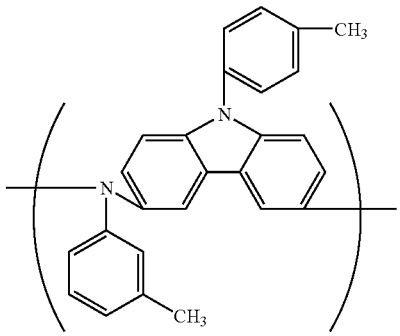
(CT-73)
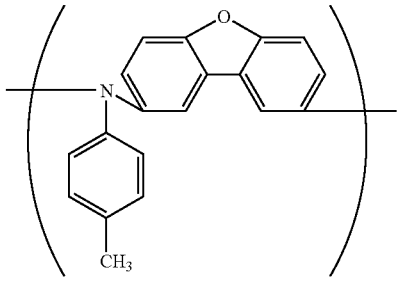
(CT-74)
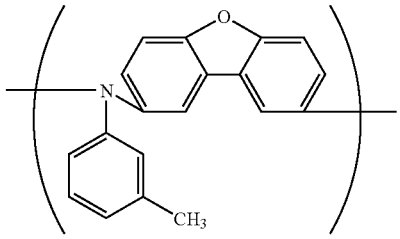
(CT-75)
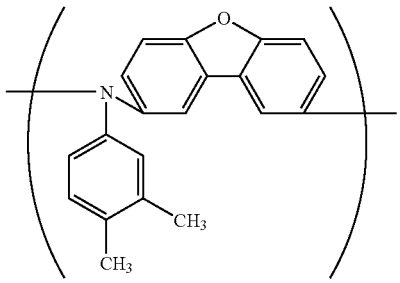

-continued
(CT-76)
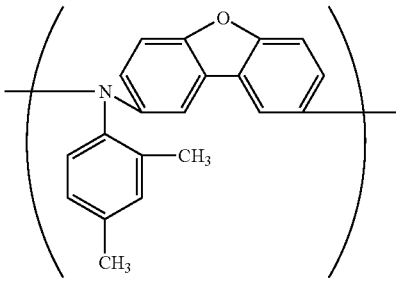
(CT-77)
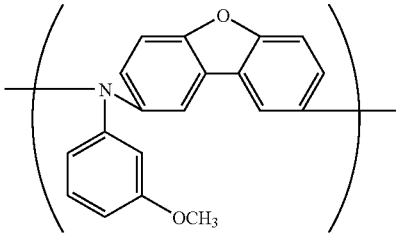
(CT-78)
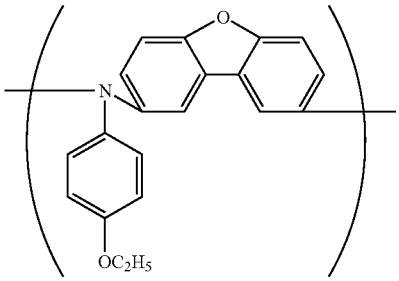
(CT-79)
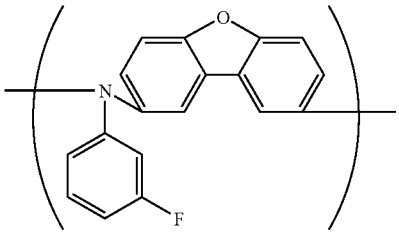
(CT-80)
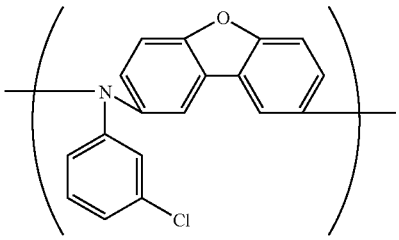
(CT-81)
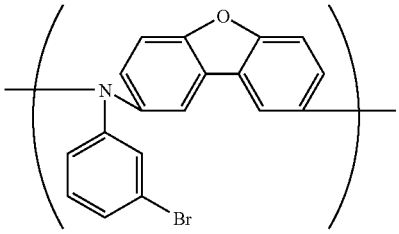
-continued
(CT-82)
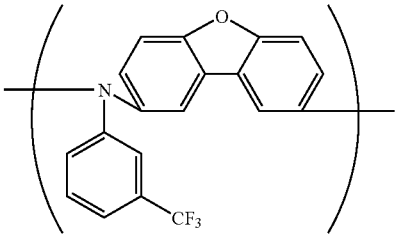
(CT-83)
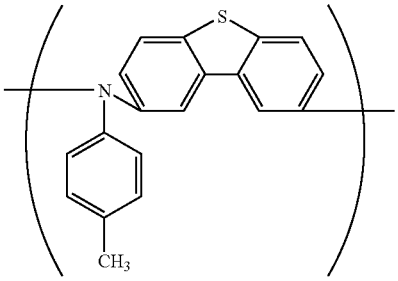
(CT-84)
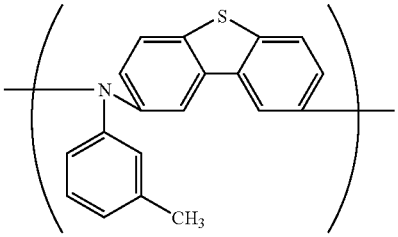
(CT-85)
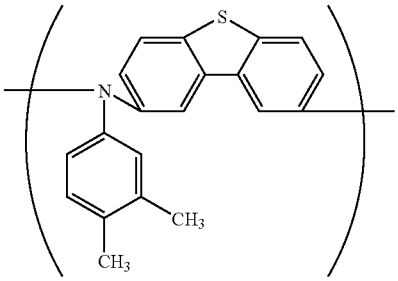
(CT-86)
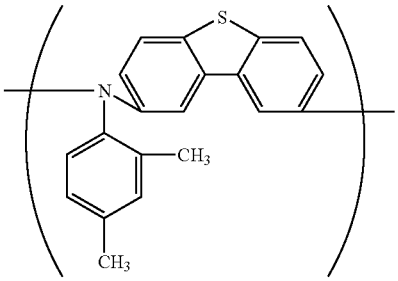
(CT-87)
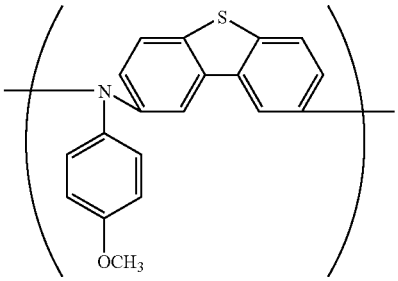

-continued (CT-88)

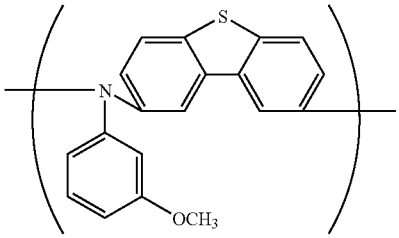

(CT-89)

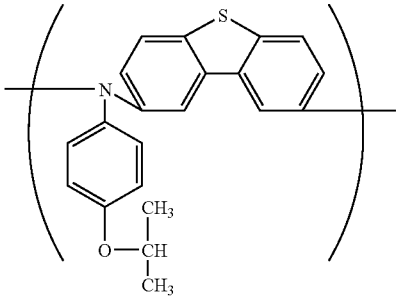

(CT-90)

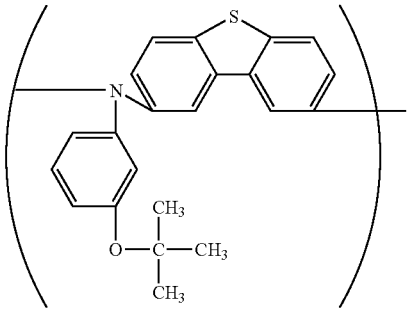

(CT-91)

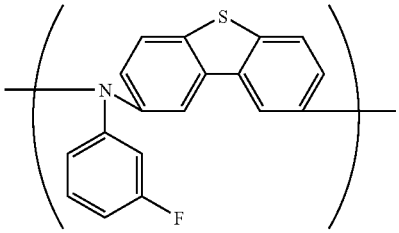

(CT-92)

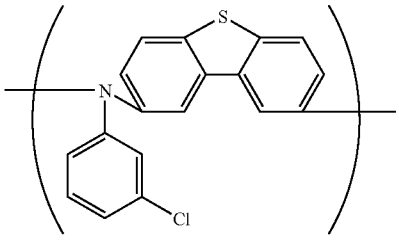

(CT-93)

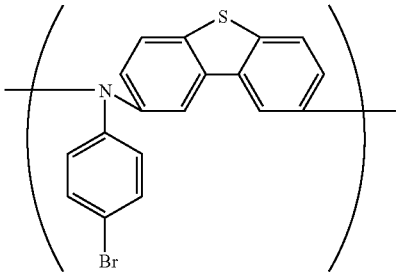

-continued (CT-94)

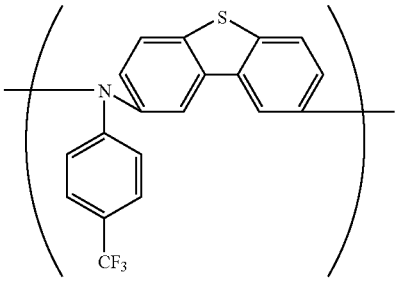

Of the high-molecular-weight charge-transporting materials of the present invention, examples of structures of the high-molecular-weight charge-transporting material which is the random copolymer having the repeating structural units represented by the above Formulas (21) and (22) (hereinafter "random copolymer type high-molecular-weight charge-transporting material of the present invention") are shown in Table 1 below. The present invention is by no means limited to these.

TABLE 1

| | Repeating Structural Units | | |
|---|---|---|---|
| Structure | (1) | (2) | (3) |
| CTR-1 | CT-2 | CT-45 | — |
| CTR-2 | CT-2 | CT-47 | — |
| CTR-3 | CT-4 | CT-64 | — |
| CTR-4 | CT-4 | CT-67 | — |
| CTR-5 | CT-4 | CT-76 | — |
| CTR-6 | CT-6 | CT-77 | — |
| CTR-7 | CT-4 | CT-86 | — |
| CTR-8 | CT-2 | CT-84 | — |
| CTR-9 | CT-6 | CT-87 | — |
| CTR-10 | CT-4 | CT-19 | — |
| CTR-11 | CT-2 | CT-74 | CT-66 |
| CTR-12 | CT-2 | CT-30 | CT-68 |
| CTR-13 | CT-45 | CT-74 | — |
| CTR-14 | CT-63 | CT-46 | — |
| CTR-15 | CT-2 | CT-62 | — |
| CTR-16 | CT-14 | CT-93 | — |

Of these, CTR-5, CTR-7, CTR-8 and CTR-11 are preferred.

Of the high-molecular-weight charge-transporting materials of the present invention, examples of structures of the high-molecular-weight charge-transporting material which is the alternating copolymer alternately having the repeating structural unit represented by the above Formula (31) and the repeating structural unit represented by the above Formula (32) (hereinafter "alternating copolymer type high-molecular-weight charge-transporting material of the present invention") are shown in Table 2 below. The present invention is by no means limited to these.

TABLE 2

| | Repeating Structural Units | |
|---|---|---|
| Structure | (1) | (2) |
| CTA-1 | CT-2 | CT-45 |
| CTA-2 | CT-4 | CT-47 |
| CTA-3 | CT-4 | CT-64 |
| CTA-4 | CT-4 | CT-67 |

TABLE 2-continued

| Structure | Repeating Structural Units (1) | (2) |
|---|---|---|
| CTA-5 | CT-1 | CT-73 |
| CTA-6 | CT-2 | CT-74 |
| CTA-7 | CT-2 | CT-30 |
| CTA-8 | CT-6 | CT-77 |
| CTA-9 | CT-4 | CT-86 |
| CTA-10 | CT-2 | CT-84 |
| CTA-11 | CT-6 | CT-88 |
| CTA-12 | CT-4 | CT-17 |

Of these, CTA-5, CTA-6, CTA-9 and CTA-10 are preferred.

The high-molecular-weight charge-transporting material used in the electrophotographic photosensitive member of the present invention may be either of the homopolymer having a single repeating structural unit and the copolymer having a plurality of repeating structural units. Employment of the copolymer having a plurality of repeating structural units enables control of ionization potential of the high-molecular-weight charge-transporting material. The ionization potential of charge-transporting materials has an influence on the matching with charge-generating materials and besides on the oxidation due to discharge at the time of charging in electrophotographic processes, and may preferably be set a little higher so that the deterioration due to oxidation in repeated service can be controlled. As the copolymer, it may also be any of the random copolymer, the alternating copolymer and a block copolymer. In view of the compatibility with the binder resin, the random copolymer and the alternating copolymer are referred. In particular, the random copolymer is more referred.

The electrophotographic photosensitive member of the present invention is constructed as described below.

The electrophotographic photosensitive member of the present invention has the photosensitive layer on the support.

The photosensitive layer of the electrophotographic photosensitive member of the present invention may be either of a single-layer type photosensitive layer, in which a charge-generating material and a charge-transporting material are contained in the same layer, and a multi-layer type, which is functionally separated into a charge generation layer containing a charge-generating material and a charge transport layer containing a charge-transporting material. In view of electrophotographic performance, the multi-layer type is preferred.

The support may be any of those having a conductivity (conductive support), and may include supports made of metal such as aluminum or stainless steel, and supports made of metal, paper or plastic on which a layer providing conductivity is formed. As the shape of the support, it may be in the shape of a cylinder, a belt or the like.

Where laser light is used in imagewise exposure, a conductive layer may be provided on the support for the purpose of preventing interference fringes due to light scattering or for the purpose of covering any scratches of the support. The conductive layer may be formed of a binder resin in which conductive particles such as carbon black and metal particles have been dispersed. The conductive layer may preferably have a layer thickness of from 5 μm to 40 μm, and particularly more preferably from 10 μm to 30 μm. Incidentally, the interference fringes may also be prevented by treating the surface of the support by cutting, anodizing, dry-process blasting, wet-process blasting or the like.

Between the support or conductive layer and the photosensitive layer, an intermediate layer may also be provided which has the function of bonding or the function as a barrier. To form the intermediate layer, a resin such as polyamide, polyvinyl alcohol, polyethylene oxide, ethyl cellulose, casein, polyurethane or polyether-urethane may be dissolved in a suitable solvent, and the resulting solution may be coated on the support or conductive layer, followed by drying. The intermediate layer may preferably have a layer thickness of from 0.05 μm to 5 μm, and particularly more preferably from 0.3 μm to 1 μm.

On the support, conductive layer or intermediate layer, the photosensitive layer is provided.

The multi-layer type photosensitive layer, which is functionally separated into a charge generation layer containing a charge-generating material and a charge transport layer containing a charge-transporting material, is described first.

The charge-generating material may include selenium-tellurium dyes, pyrylium dyes, thiapyrylium dyes, phthalocyanine pigments, anthanthrone pigments, dibenspirene-quinone pigments, trisazo pigments, cyanine pigments, azo (trisazo, disazo and monoazo) pigments, indigo pigments, quinacridone pigments and asymmetric quinocyanine pigments.

To form the charge generation layer, the charge-generating material may be well dispersed together with a 0.3- to 4-fold quantity of binder resin and a suitable solvent by means of a homogenizer, an ultrasonic dispersion machine, a ball mill, a vibrating ball mill, a sand mill, an attritor, a roll mill, a liquid impact type high-speed dispersion machine or the like, and the dispersion obtained may be coated, followed by drying. Incidentally, the binder resin may be introduced after the charge-generating material has been dispersed, or the binder resin may be not used if the charge-generating material has film-forming properties. The charge generation layer may preferably have a layer thickness of 5 μm or less, and particularly more preferably from 0.1 μm to 2 μm.

Where the charge transport layer is the surface layer of the electrophotographic photosensitive member, the charge-transporting material used in such charge transport layer is the high-molecular-weight charge-transporting material of the present invention.

To form the charge transport layer, the high-molecular-weight charge-transporting material of the present invention may be dissolved with a solvent, or preferably the high-molecular-weight charge-transporting material of the present invention and the electrically insulating binder resin may be dissolved with a solvent, and the coating solution obtained may be coated, followed by drying. The charge transport layer may preferably have a layer thickness of from 5 μm to 40 μm, more preferably from 10 μm to 35 μm, and still more preferably from 15 μm to 30 μm.

The high-molecular-weight charge-transporting material of the present invention and the electrically insulating binder resin may preferably be in a weight ratio of from 2:1 to 1:10, more preferably from 1:1 to 1:8, and still mote preferably from 1:2 to 1:4.

The electrically insulating binder resin may be any of electrically insulating binder resins commonly used in electrophotographic photosensitive members. In particular, polycarbonate resins and polyarylate resins are especially favorable in order to bring out the effect of the present invention.

The polycarbonate resins and the polyarylate resins are both obtainable by conventional methods. In particular, a polycarbonate resin obtained by polycondensation using bisphenol and phosgene and a polyarylate resin obtained by polycondensation using bisphenol and a dicarboxylic-acid chloride are preferred because electrophotographic performance such as sensitivity can be improved in view of purity as being, e.g., residue-free and also because mechanical properties such as mechanical strength can be improved in view of molecular weight and molecular weight distribution.

The polycarbonate resin may preferably have a weight-average molecular weight Mw in the range of from 40,000 to 200,000, and the polyarylate resin may preferably have a weight-average molecular weight Mw in the range of from 40,000 to 200,000.

A low-molecular-weight charge-transporting material may also be used in combination as long as the effect of the present invention is not damaged. From the viewpoint that the effect of the present invention is not damaged, structure(s) having charge transport performance of the high-molecular-weight charge-transporting material of the present invention (e.g., the repeating structural unit represented by the above Formula (1) or the repeating structural units represented by the above Formulas (21) and (22)) may preferably be in a proportion of 50 mol % or more, and still more preferably 70 mol % or more, based on the whole structures having charge transport performance (i.e., the sum of the repeating structural unit(s) and the low-molecular-weight charge-transporting material). The low-molecular-weight charge-transporting material may include, e.g., triarylamine compounds, hydrazone compounds, stilbene compounds, pyrazoline compounds, oxazole compounds, triallylmethane compounds and thiazole compounds.

Where the photosensitive layer is the single-layer type photosensitive layer and the single-layer type photosensitive layer is the surface layer of the electrophotographic photosensitive member, the single-layer type photosensitive layer may be formed by dispersing the charge-generating material, the high-molecular-weight charge-transporting material of the present invention and so forth in the electrically insulating binder resin, and coating the resulting dispersion, followed by drying. The single-layer type photosensitive layer may preferably have a layer thickness of from 5 μm to 40 μm, and more preferably from 15 μm to 30 μm.

For the purpose of protecting the photosensitive layer, a protective layer may also be provided on the photosensitive layer, and this may be made to serve as the surface layer.

The protective layer serving as the surface layer of the electrophotographic photosensitive member may be formed by dissolving the high-molecular-weight charge-transporting material of the present invention and the electrically insulating binder resin in a suitable solvent, and coating the resulting coating solution on the photosensitive layer, followed by drying. The protective layer may preferably have a layer thickness of from 0.05 μm to 20 μm.

A lubricant for providing lubricity or a filler for improving mechanical strength may also be added to the surface layer of the electrophotographic photosensitive member of the present invention.

When the above respective layers are formed, they may be formed by any coating method including dip coating, spray coating, spinner coating, blade coating and roll coating.

In the present invention, the weight-average molecular weight Mw is measured in the following way.

Measurement of weight-average molecular weight Mw:

The weight-average molecular weight is measured by a conventional method, using a gel permeation chromatography (GPC) apparatus (trade name: HLC8120GPC; manufactured by Tosoh Corporation).

A measurement target sample is put in THF (tetrahydrofuran), and is left to stand for several hours, followed by thorough shaking so as to be well mixed with the THF (until coalescent matter of the sample has disappeared), which is further left to stand for at least 12 hours. Thereafter, the solution having been passed through a sample-treating filter (trade name: MAISHORIDISK H-25-5; available from Tosoh Corporation; pore size: 0.45 to 0.5 μm) is used as the sample for GPC. The sample is so prepared that the measurement target sample is in a concentration of from 0.5 to 5 mg/ml.

Using the sample for GPC thus prepared, the weight-average molecular weight of the measurement target sample is measured in the following way.

Columns are stabilized in a heat chamber of 40° C. To the columns kept at this temperature, THF as a solvent is flowed at a flow rate of 1 ml per minute, and about 10 μl of the sample for GPC is injected thereinto to make measurement.

In measuring the molecular weight of the measurement target sample, the molecular weight distribution the measurement target sample has is calculated from the relationship between the logarithmic value of a calibration curve prepared using several kinds of monodisperse polystyrene standard samples and the count number.

As the standard polystyrene samples used for preparing the calibration curve, 10 standard polystyrene samples with molecular weights of from $10^2$ to $10^7$ are used, which are available from Tosoh Corporation.

An RI (refractive index) detector is used as a detector.

As the columns, TSKgel series are used, which are available from Tosoh Corporation.

Measurement of number-average molecular weight Mn:

Measured in the same way as the measurement of weight-average molecular weight Mw.

The high-molecular-weight charge-transporting material described above, having a specific molecular weight distribution, may be obtained by a method in which a polymer is synthesized by applying condensation reaction making use of a conventional process such as the coupling process disclosed in, e.g., DAI YUUKI KAGAKU (Grand Organic Chemistry), Vol.16, Asakura Shoten (1995), followed by separation of the necessary molecular weight component by preparative GPC (gel permeation chromatography) or the like; or a method in which, as shown in Synthesis Examples given later, a dihalide is allowed to react with a halide having an amino group, to synthesize a compound whose molecular weight distribution has been narrow-controlled to a certain degree, followed by treatment with an adsorbent such as activated clay, activated carbon or cerite to remove the high-molecular-weight component, and further followed by reprecipitation using as a bad solvent a solvent such as acetone, capable of dissolving the low-molecular-weight component.

The FIGURE schematically illustrates the construction of an electrophotographic apparatus provided with a process cartridge having the electrophotographic photosensitive member of the present invention.

In the FIGURE, reference numeral 1 denotes a drum-shaped electrophotographic photosensitive member of the present invention, which is rotatingly driven around an axis 2 in the direction of an arrow at a stated peripheral speed.

The electrophotographic photosensitive member 1 is, being rotatingly driven, uniformly electrostatically charged on its peripheral surface to a positive or negative, given potential through a charging means (primary charging means) 3. The electrophotographic photosensitive member thus charged is then exposed to exposure light (imagewise exposure light) 4 emitted from an exposure means (not shown) for slit exposure or laser beam scanning exposure. In this way, electrostatic latent images corresponding to the intended image information are successively formed on the peripheral surface of the electrophotographic photosensitive member 1.

The electrostatic latent images thus formed on the peripheral surface of the electrophotographic photosensitive member 1 are developed with toner by the operation of a developing means 5. The toner images thus formed and held on the peripheral surface of the electrophotographic photosensitive member 1 are then successively transferred by the aid of transfer bias applied from a transfer means (transfer roller) 6, to a transfer material (such as paper) P taken out and fed from a transfer material feed means (not shown) to the part (contact part) between the electrophotographic photosensitive member 1 and the transfer means 6 in the manner synchronized with the rotation of the electrophotographic photosensitive member 1.

The transfer material P onto which the toner images have been transferred is separated from the peripheral surface of the electrophotographic photosensitive member 1, is led through a fixing means 8, where the toner images are fixed, and is then put out of the apparatus as an image-formed material (a print or copy).

The peripheral surface of the electrophotographic photosensitive member 1 from which images have been transferred is brought to removal of transfer residual toner through a cleaning means (cleaning blade) 7. Thus, its surface is cleaned. The electrophotographic photosensitive member is further subjected to charge elimination by pre-exposure light (not shown) emitted from a pre-exposure means (not shown), and then repeatedly used for the formation of images. Incidentally, where the charging means 3 is a contact charging means making use of a charging roller or the like as shown in the FIGURE, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is detachably mountable to the main body of an electrophotographic apparatus such as a copying machine or a laser beam printer. In the apparatus shown in the FIGURE, the electrophotographic photosensitive member 1, the charging means 3, the developing means 5 and the cleaning means 7 are integrally supported in a cartridge to form a process cartridge 9 that is detachably mountable to the main body of the electrophotographic apparatus through a guide means 10 such as rails provided in the main body of the electrophotographic apparatus.

The present invention is described below in greater detail by giving Examples.

SYNTHESIS EXAMPLE 1

4.06 g (0.01 mol) of 2,7-diiodobiphenyl and 27.05 g (0.08 mol) of 4-(4-methylphenyl)amino-4'-bromo-biphenyl were dissolved in 50 ml of dry tetrahydrofuran, followed by addition of 160 mg of palladium acetate, 870 mg of tri-o-tolylphosphine and 2.8 g of tert-butoxysodium to effect heating and reflux for 2 hours, and further followed by addition of 620 mg of 2-(di-tert-butylphospheno)biphenyl and 2.8 g of tert-butoxysodium to effect heating and reflux for 3 hours.

The resulting reaction mixture was left to cool, from which the catalyst was removed thereafter, and then poured into acetone to obtain a grayish brown solid.

The solid thus obtained was further again dissolved in toluene, and was subjected to treatment with activated clay, followed by reprecipitation from acetone to carry out purification to obtain 5.2 g of a pale yellow solid.

This pale yellow solid was the homopolymer high-molecular-weight charge-transporting material having the repeating structural unit represented by the formula CT-1 (called "high-molecular-weight charge-transporting material CT-1"; the same applies hereinafter). Its molecular weight was analyzed by GPC to find that Mw was 2,300 and Mw/Mn was 1.07.

SYNTHESIS EXAMPLE 2

4.36 g (0.01 mol) of 2,8-diiododibenzofuran and 20.05 g (0.06 mol) of 4-(2,4-dimethylphenyl)amino-4'-bromo-biphenyl were dissolved in 50 ml of dry tetrahydrofuran, followed by addition of 120 mg of palladium acetate, 650 mg of tri-o-tolylphosphine and 2.8 g of tert-butoxysodium to effect heating and reflux for 2 hours, and further followed by addition of 620 mg of 2-(di-tert-butylphospheno)biphenyl and 2.8 g of tert-butoxysodium to effect heating and reflux for 4 hours.

The resulting reaction mixture was left to cool, from which the catalyst was removed thereafter, and then poured into acetone to obtain a grayish brown solid.

The solid thus obtained was further again dissolved in toluene, and subjected to treatment with activated clay, followed by reprecipitation from acetone to carry out purification to obtain 4.1 g of a pale yellow solid.

This pale yellow solid was the high-molecular-weight charge-transporting material CTR-5, and the compositional ratio of CT-4 to CT-76 was 1:1. Its molecular weight was also analyzed by GPC to find that Mw was 1,700 and Mw/Mn was 1.05.

SYNTHESIS EXAMPLE 3

3.6 g (0.01 mol) of N,N'-di(3-methylphenyl)benzidine and 3.42 g (0.01 mol) of 2,8-dibromodibenzothiophene were dissolved in 20 ml of dry o-xylene, followed by addition of 10 mg of palladium acetate, 55 mg of 2-(di-tert-butylphospheno)biphenyl and 1.34 g (0.014 mol) of tert-butoxysodium to effect heating and reflux for 4 hours, and further followed by addition of 0.5 g of 4-bromotoluene to effect heating and reflux for 2 hours.

The resulting reaction mixture was left to cool, from which the catalyst was removed thereafter, and then poured into acetone to obtain a yellow solid.

The solid thus obtained was further again dissolved in tetrahydrofuran, and subjected to preparative GPC to separate 0.6 g of a component having Mw of 3,200 and Mw/Mn of 1.08.

This product thus separated was the high-molecular-weight charge-transporting material CTA-10 (copolymerization ratio: 1:1).

Other high-molecular-weight charge-transporting materials are also obtainable in the same way as in Synthesis Examples 1 to 3.

In the following Examples, "part(s)" refers to "part(s) by weight."

EXAMPLE 1

An aluminum cylinder of 30 mm in diameter and 357.5 mm in length was used as the support. First, the support surface was cleaned with a surface-active agent in an aqueous system by means of an ultrasonic cleaner. Next, this was immersed in 80° C. pure water and then drawn up. Thus, the support surface was cleaned and dried.

The support having been surface-cleaned and dried was dip-coated thereon with a conductive layer forming coating dispersion made up of the following materials, followed by heat curing at 140° for 30 minutes to form a conductive layer with a layer thickness of 15 μm.

| | |
|---|---|
| Conductive pigment: $SnO_2$-coated barium sulfate | 10 parts |
| Resistance-adjusting pigment: Titanium oxide | 2 parts |
| Binder resin: Phenol resin | 6 parts |
| Leveling agent: Silicone oil | 0.001 part |
| Solvent: Methanol/methoxypropanol = 2/8 | 20 parts |

Next, 3 parts of N-methoxymethylated nylon and 3 parts of copolymer nylon were dissolved in a mixed solvent of 65 parts of methanol and 30 parts of n-butanol to prepare a solution, and this was dip-coated on the conductive layer, followed by drying to form an intermediate layer with a layer thickness of 0.6 μm.

Next, 4 parts of hydroxygallium phthalocyanine crystals of a crystal form having strong peaks at Bragg's angles (2θ±0.2°) of 7.3° and 28.1° in the CuK a characteristic X-ray diffraction, 2 parts of polyvinyl butyral resin (trade name: S-LEC BX-1; available from Sekisui Chemical Co., Ltd.) and 60 parts of cyclohexanone were subjected to dispersion for 4 hours by means of a sand mill making use of glass beads of 1 mm in diameter, followed by addition of 100 parts of ethyl acetate to prepare a charge generation layer coating dispersion. This charge generation layer coating dispersion was dip-coated on the intermediate layer, followed by drying at 90° C. for 10 minutes to form a charge generation layer with a layer thickness of 0.2 μm.

Next, 4 parts of the high-molecular-weight charge-transporting material CT-1 obtained in Synthesis Example 1 and 10 parts of polycarbonate resin (PC-Z type; trade name: IUPILON Z-400; available from Mitsubishi Engineering Co., Ltd.) were dissolved in a mixed solvent of 70 parts of monochlorobenzene and 30 parts of dichloromethane to prepare a charge transport layer coating solution. This charge transport layer coating solution was dip-coated on the charge generation layer, followed by drying at 120° C. for 1.5 hours to form a charge transport layer shown in Table 3, with a layer thickness of 25 μm.

The electrophotographic photosensitive member thus produced was evaluated as described below.

An evaluation apparatus is a copying machine GP405 (process speed of 210 mm/s), manufactured by CANON INC., having construction as shown in the FIGURE. Its charging means is a contact charging means making use of a charging roller. A DC voltage on which an AC voltage has been superimposed is applied to the charging roller. The exposure means employs laser beams as exposure light. The developing means is of a one-component magnetic negative toner non-contact development system. The transfer means is a contact transfer means making use of a transfer roller. The cleaning means is a cleaning blade made of rubber, set in the counter direction. A fuse lamp is employed as the pre-exposure means.

The electrophotographic photosensitive member produced was set in this evaluation apparatus. In an environment of high temperature and high humidity (H/H: 30° C., 85% RH), the dark-area potential (Vd) and the light-area potential (Vl) were measured; the former being at the time the AC component of the voltage applied to the charging roller was set to 1,800 Vpp and 1,500 Hz and the DC component thereof was set to −800 V, and latter being under irradiation by 780 nm laser exposure light in an amount of 0.7 $\mu J/cm^2$.

Thereafter, 30,000-sheet paper feed running was evaluated. As its sequence, an intermittent mode was set up in which, in A4-size 6% image area printing, the printing was stopped once for each sheet (10 seconds/sheet). When the toner runned out, it was replenished.

The depth of wear of the surface layer (charge transport layer) of the electrophotographic photosensitive member having been evaluated in the 30,000-sheet paper feed running was also measured with a layer thickness meter making use of eddy current. At the same time, the depth of scratches (Rmax) having formed at the surface layer (charge transport layer) was measured with a surface profile analyzer (trade name: SURFCOADER SE3400, manufactured by Kosaka Laboratory Ltd.).

The results of the above evaluation are shown in Table 4.

EXAMPLE 2

An electrophotographic photosensitive member was produced in the same manner as in Example 1 except that the high-molecular-weight charge-transporting material used therein in the charge transport layer was changed for the high-molecular-weight charge-transporting material CTR-5 obtained in Synthesis Example 2. Evaluation was made in the same way. The results of evaluation are shown in Table 4.

EXAMPLE 3

An electrophotographic photosensitive member was produced in the same manner as in Example 1 except that the high-molecular-weight charge-transporting material used therein in the charge transport layer was changed for the high-molecular-weight charge-transporting material CTA-10 obtained in Synthesis Example 3. Evaluation was made in the same way. The results of evaluation are shown in Table 4.

EXAMPLES 4 TO 7

Electrophotographic photosensitive members were produced in the same manner as in Example 1 except that the high-molecular-weight charge-transporting material used therein in the charge transport layer was changed for those having the structure, compositional ratio and weight-average molecular weight as shown in Table 3. Evaluation was made in the same way. The results of evaluation are shown in Table 4. Here, the random-copolymer high-molecular-weight charge-transporting materials used were all in a copolymerization ratio of 1:1.

EXAMPLE 8

An electrophotographic photosensitive member was produced in the same manner as in Example 2 except that the binder resin used therein in the charge transport layer was changed for a polyarylate resin having a repeating structural unit (PAR-C type) represented by the following formula (Mw: 100,000; phthalic-acid structure moiety: tere-structure/iso-structure=5/5 in molar ratio). Evaluation was made in the same way. The results of evaluation are shown in Table 4.

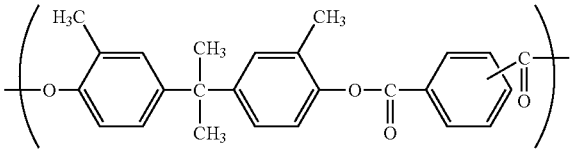

EXAMPLE 9

An electrophotographic photosensitive member was produced in the same manner as in Example 5 except that the binder resin used therein in the charge transport layer was changed for a copolymer polyarylate resin having the above PAR-C type repeating structural unit and a repeating structural unit (PAR-TMBP type) represented by the following formula (PAR-C type/PAR-TMBP type=7/3 in molar ratio; Mw: 120,000; phthalic-acid structure moiety: tere-structure/iso-structure=5/5 in molar ratio). Evaluation was made in the same way. The results of evaluation are shown in Table 4.

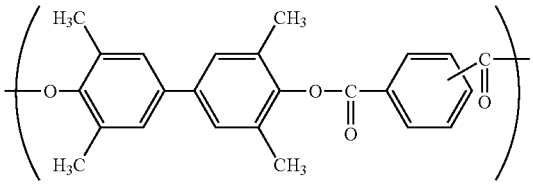

EXAMPLE 10

An electrophotographic photosensitive member was produced in the same manner as in Example 8 except that the high-molecular-weight charge-transporting material used therein in the charge transport layer was changed for one having the structure, compositional ratio and weight-average molecular weight as shown in Table 3. Evaluation was made in the same way. The results of evaluation are shown in Table 4. Here, the random-copolymer high-molecular-weight charge-transporting material used was in a copolymerization ratio of 1:1.

COMPARATIVE EXAMPLE 1

An electrophotographic photosensitive member was produced in the same manner as in Example 1 except that a high-molecular-weight charge-transporting material CT-1 (Mw: 2,800; Mw/Mn: 1.52) was used as a charge-transporting material, which was obtained in the same manner as in Synthesis Example 1 except that only the coloring component used therein was removed by column chromatography making use of alumina, in place of the treatment with activated clay. Evaluation was made in the same way. The results of evaluation are shown in Table 4.

COMPARATIVE EXAMPLE 2

An electrophotographic photosensitive member was produced in the same manner as in Example 2 except that a high-molecular-weight charge-transporting material CTR-5 (Mw: 1,100; Mw/Mn: 1.70; copolymerization ratio: 1:1) was used as a charge-transporting material, which was obtained in the same manner as in Synthesis Example 2 except that the acetone used therein was changed for methanol. Evaluation was made in the same way. The results of evaluation are shown in Table 4.

COMPARATIVE EXAMPLE 3

An electrophotographic photosensitive member was produced in the same manner as in Example 3 except that a high-molecular-weight charge-transporting material CTA-10 (copolymerization ratio: 1:1) was used as a charge-transporting material, which was obtained in the same manner as in Synthesis Example 3 except that the preparative GPC was carried out to separate a component of Mw=9,300 and Mw/Mn=1.09. Evaluation was made in the same way. The results of evaluation are shown in Table 4.

COMPARATIVE EXAMPLE 4

An electrophotographic photosensitive member was produced in the same manner as in Example 3 except that a high-molecular-weight charge-transporting material CTA-10 (Mw: 2,800; Mw/Mn: 3.14; copolymerization ratio: 1:1) was used as a charge-transporting material, which was obtained in the same manner as in Synthesis Example 3 except that the preparative GPC was not carried out. Evaluation was made in the same way. The results of evaluation are shown in Table 4.

COMPARATIVE EXAMPLE 5

An electrophotographic photosensitive member was produced in the same manner as in Example 1 except that, as the charge-transporting material used therein, 8 parts of a compound (low-molecular-weight charge-transporting material) having structure represented by the following formula. Evaluation was made in the same way. The results of evaluation are shown in Table 4.

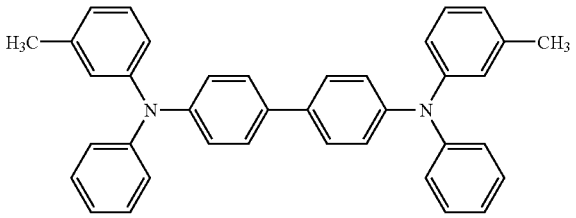

TABLE 3

| | Charge Transport Layer | | | |
|---|---|---|---|---|
| | High-molecular-weight Charge-transporting Material | | | Binder |
| | | Mw | Mw/Mn | Resin |
| | Example | | | |
| 1 | CT-1 | 2,300 | 1.07 | PC-Z |
| 2 | CTR-5 | 1,700 | 1.05 | PC-Z |
| 3 | CTA-10 | 3,200 | 1.08 | PC-Z |
| 4 | CTR-13 | 3,900 | 1.10 | PC-Z |
| 5 | CTR-14 | 2,700 | 1.05 | PC-Z |

TABLE 3-continued

| | Charge Transport Layer | | | |
|---|---|---|---|---|
| | High-molecular-weight Charge-transporting Material | | | Binder |
| | | Mw | Mw/Mn | Resin |
| 6 | CTR-15 | 1,800 | 1.09 | PC-Z |
| 7 | CTR-16 | 3,300 | 1.06 | PC-Z |
| 8 | CTR-5 | 1,700 | 1.05 | PAR-C |
| 9 | CTR-14 | 2,700 | 1.05 | PAR-C/ PAR-TMBP |
| 10 | CTA-9 | 2,200 | 1.01 | PAR-C |
| | | Comparative Example | | |
| 1 | CT-1 | 2,800 | 1.52 | PC-Z |
| 2 | CTR-5 | 1,100 | 1.70 | PC-Z |
| 3 | CTA-10 | 9,300 | 1.09 | PC-Z |
| 4 | CTA-10 | 2,800 | 3.14 | PC-Z |
| 5 | Low-molecular-weight Charge-transporting Material | 454 | 1.00 | PC-Z |

TABLE 4

| | Potential Characteristics (Vd/VI) | | Depth of Wear (μm/ | Depth of Scratches |
|---|---|---|---|---|
| | Initial Stage | After Running | 10,000 sheets) | Rmax (μm) |
| | | Example | | |
| 1 | 710/150 | 700/170 | 3.7 | 2.6 |
| 2 | 710/160 | 700/180 | 3.5 | 2.3 |
| 3 | 710/150 | 710/165 | 3.5 | 2.4 |
| 4 | 710/160 | 700/170 | 3.5 | 2.4 |
| 5 | 715/150 | 710/165 | 3.4 | 2.4 |
| 6 | 710/180 | 700/195 | 3.5 | 2.4 |
| 7 | 710/190 | 700/210 | 3.7 | 2.5 |
| 8 | 710/160 | 700/180 | 2.7 | 1.5 |
| 9 | 710/160 | 700/180 | 2.6 | 1.3 |
| 10 | 710/160 | 705/175 | 2.7 | 1.6 |
| | | Comparative Example | | |
| 1 | 710/230 | 700/280 | 3.9 | 4.1 |
| 2 | 710/170 | 700/190 | 3.5 | 3.9 |
| 3 | 710/190 | 690/210 | 3.5 | 3.8 |
| 4 | 710/180 | 680/205 | 3.6 | 3.8 |
| 5 | 710/160 | 700/175 | 4.7 | 4.8 |

As shown in the Examples, the electrophotographic photosensitive members of the present invention had superior initial-stage sensitivity, was less subjected to change in light-area potential due to running and was able to obtain good images even when used repeatedly. In addition, the surface layer photosensitive layers (charge transport layers) of the electrophotographic photosensitive members less worn and was less scratched. In particular, the depth of scratches after running was in a very good condition, compared with the Comparative Examples.

On the other hand, lines coming from scratches of the electrophotographic photosensitive member surfaces appeared on images. Various factors therefor are presumed. In respect of Comparative Examples 2, 3 and 4, it is considered that the high-molecular-weight charge-transporting material has not uniformly been dispersed in the binder resin to stand localized, and that the film strength has come non-uniform because of an insufficient compatibility. In respect of Comparative Examples 1 and 5, it is also considered that the charge transport layer has had a very low strength because of the low-molecular-weight charge-transporting material used in a large quantity, so that the surfaces were seriously scratched.

The present invention makes it possible to provide the electrophotographic photosensitive member having high surface mechanical strength, having superior durability (wear resistance or scratch resistance) and also having stability in repeated use, and the process cartridge and the electrophotographic apparatus which have such electrophotographic photosensitive member.

What is claimed is:

1. An electrophotographic photosensitive member comprising a support, and provided thereon a photosensitive layer, wherein;

a surface layer of the electrophotographic photosensitive member contains a high-molecular-weight charge-transporting material having a weight-average molecular weight Mw of from 1,000 or more to 9,000 or less; and the ratio of the weight-average molecular weight Mw of the high-molecular-weight charge-transporting material to a -number-average molecular weight Mn of the high-molecular-weight charge-transporting material, Mw/Mn, is from more than 1.00 to 1.10 or less.

2. The electrophotographic photosensitive member according to claim 1, wherein said high-molecular-weight charge-transporting material has an weight-average molecular weight Mw of from 1,500 or more to 4,000 or less.

3. The electrophotographic photosensitive member according to claim 1, wherein said high-molecular-weight charge-transporting material is a homopolymer having a repeating structural unit represented by the following Formula (1):

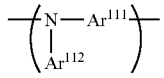

(1)

wherein $Ar^{111}$ represents a substituted or unsubstituted divalent aromatic hydrocarbon ring group other than a phenylene group, or a substituted or unsubstituted divalent aromatic heterocyclic ring group; and $Ar^{112}$ represents a substituted or unsubstituted monovalent aromatic hydrocarbon ring group or a substituted or unsubstituted monovalent aromatic heterocyclic ring group.

4. The electrophotographic photosensitive member according to claim 1, wherein said high-molecular-weight charge-transporting material is a random copolymer having a repeating structural unit represented by the following Formula (21) and a repeating structural unit represented by the following Formula (22):

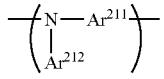

(21)

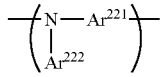

(22)

wherein $Ar^{211}$ and $Ar^{221}$ each independently represent a substituted or unsubstituted divalent aromatic hydrocarbon ring group other than a phenylene group, or a substituted or unsubstituted divalent aromatic heterocyclic ring group; and $Ar^{212}$ and $Ar^{222}$ each independently represent a substituted or unsubstituted monovalent aromatic hydrocarbon ring group or a substituted or unsubstituted monovalent aromatic heterocyclic ring group; provided that a case is excluded in which the repeating structural unit represented by Formula (21) and the repeating structural unit represented by Formula (22) are identical in structure.

5. The electrophotographic photosensitive member according to claim 1, wherein said high-molecular-weight charge-transporting material is an alternating copolymer alternately having a repeating structural unit represented by the following Formula (31) and a repeating structural unit represented by the following Formula (32):

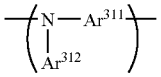

(31)

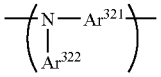

(32)

wherein $Ar^{311}$ and $Ar^{321}$ each independently represent a divalent group having a structure represented by the following Formula (41) or the following Formula (42), provided that $Ar^{311}$ and $Ar^{321}$ differ from each other in structure:

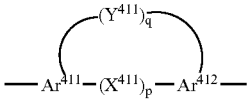

(41)

where $Ar^{411}$ and $Ar^{421}$ each independently represent a substituted or unsubstituted trivalent aromatic hydrocarbon ring group or a substituted or unsubstituted trivalent aromatic heterocyclic ring group; $X^{411}$ represents a substituted or unsubstituted alkylene group, a substituted or unsubstituted siloxane group, a substituted or unsubstituted silylene group, a carbonyl group, a sulfonyl group, an oxygen atom or a sulfur atom; $Y^{411}$ represents a substituted or unsubstituted alkylene group, a substituted or unsubstituted amino group, an azo group, a sulfonyl group, an oxygen atom or a sulfur atom; and p and q each independently represent 0 or 1; or where $Ar^{421}$ and $Ar^{422}$ each independently represent $$—Ar^{421}—(X^{421})_r—Ar^{422}— \quad (42)$$

a substituted or unsubstituted divalent aromatic hydrocarbon ring group or a substituted or unsubstituted divalent aromatic heterocyclic ring group; $X^{421}$ represents a substituted or unsubstituted alkylene group, a substituted or unsubstituted siloxane group, a substituted or unsubstituted silylene group, a carbonyl group, a sulfonyl group, an oxygen atom or a sulfur atom; and r represents 0 or 1; and $Ar^{312}$ and $Ar^{322}$ each independently represent a substituted or unsubstituted monovalent aromatic hydrocarbon ring group or a substituted or unsubstituted monovalent aromatic heterocyclic ring group.

6. The electrophotographic photosensitive member according to claim 1, wherein said surface layer contains an electrically insulating binder resin.

7. The electrophotographic photosensitive member according to claim 6, wherein said electrically insulating binder resin is a polycarbonate resin or a polyarylate resin.

8. The electrophotographic photosensitive member according to claim 1, wherein said surface layer is said photosensitive layer.

9. The electrophotographic photosensitive member according to claim 1, wherein said photosensitive layer has a charge generation layer containing a charge-generating material and a charge transport layer containing said high-molecular-weight charge-transporting material, and said surface layer is the charge transport layer.

10. A process cartridge comprising an electrophotographic photosensitive member having a photosensitive layer on a support, and at least one means selected from the group consisting of a charging means, a developing means, a transfer means and a cleaning means which are integrally supported; and being detachably mountable to the main body of an electrophotographic apparatus; wherein;

a surface layer of said electrophotographic photosensitive member contains a high-molecular-weight charge-transporting material having a weight-average molecular weight Mw of from 1,000 or more to 9,000 or less; and the ratio of the weight-average molecular weight Mw of the high-molecular-weight charge-transporting material to a number-average molecular weight Mn of the high-molecular-weight charge-transporting material, Mw/Mn, is from more than 1.00 to 1.10 or less.

11. An electrophotographic apparatus comprising an electrophotographic photosensitive member having a photosensitive layer on a support, a charging means, an exposure means, a developing means and a transfer means, wherein;

a surface layer of said electrophotographic photosensitive member contains a high-molecular-weight charge-transporting material having a weight-average molecular weight Mw of from 1,000 or more to 9,000 or less; and the ratio of the weight-average molecular weight Mw of the high-molecular-weight charge-transporting material to a number-average molecular weight Mn of the high-molecular-weight charge-transporting material, Mw/Mn, is from more than 1.00 to 1.10 or less.

* * * * *